US008074822B1

(12) United States Patent
Kiesow et al.

(10) Patent No.: US 8,074,822 B1
(45) Date of Patent: Dec. 13, 2011

(54) LINER FILM AND PACKAGING SYSTEM WITH LINER FILM

(75) Inventors: Kenneth Eastman Kiesow, Neenah, WI (US); Rusty L. Witthuhn, Appleton, WI (US); Curtis Randolph Barr, Oshkosh, WI (US)

(73) Assignee: Milprint, Inc., Oshkosh, WI (US)

( * ) Notice: Subject to any disclaimer, the term of this patent is extended or adjusted under 35 U.S.C. 154(b) by 1335 days.

(21) Appl. No.: 11/487,083

(22) Filed: Jul. 14, 2006

(51) Int. Cl.
*B65D 35/14* (2006.01)

(52) U.S. Cl. ..... 220/495.01; 400/621

(58) Field of Classification Search ..... 220/495.01; 400/621
See application file for complete search history.

(56) References Cited

U.S. PATENT DOCUMENTS

| | | | | |
|---|---|---|---|---|
| 2,284,604 | A | 4/1940 | Brooks | |
| 3,424,595 | A * | 1/1969 | Tolman | 426/124 |
| 4,877,674 | A | 10/1989 | Kappes | |
| 5,428,939 | A | 7/1995 | Weder et al. | |
| 5,467,573 | A | 11/1995 | Weder et al. | |
| 5,493,809 | A | 2/1996 | Weder et al. | |
| 5,572,849 | A | 11/1996 | Weder et al. | |
| 5,616,400 | A | 4/1997 | Zhang | |
| 5,628,146 | A | 5/1997 | Weder et al. | |
| 5,682,720 | A | 11/1997 | Weder et al. | |
| 5,682,721 | A | 11/1997 | Weder et al. | |
| 5,682,722 | A | 11/1997 | Weder et al. | |
| 5,829,225 | A | 11/1998 | Weder et al. | |
| 5,981,650 | A | 11/1999 | Zhao et al. | |
| 6,115,962 | A | 9/2000 | Weder et al. | |
| 6,166,366 | A | 12/2000 | Lewis et al. | |
| 6,185,903 | B1 | 2/2001 | Weder et al. | |
| 6,286,255 | B1 | 9/2001 | Weder et al. | |
| 6,287,658 | B1 * | 9/2001 | Cosentino et al. | 428/40.1 |
| 6,345,469 | B2 | 2/2002 | Weder et al. | |
| 6,385,907 | B2 | 5/2002 | Weder et al. | |
| 6,393,801 | B1 | 5/2002 | Weder et al. | |
| 6,510,651 | B2 | 1/2003 | Weder et al. | |
| 6,699,541 | B2 | 3/2004 | Finestone et al. | |
| 6,706,388 | B2 | 3/2004 | Finestone et al. | |
| 6,857,226 | B2 | 2/2005 | Weder et al. | |
| 6,895,732 | B2 | 5/2005 | Sperry et al. | |
| 6,899,229 | B2 | 5/2005 | Dennison et al. | |
| 6,996,933 | B2 | 2/2006 | Weder et al. | |
| 7,096,624 | B2 | 8/2006 | Weder et al. | |
| 2003/0178329 | A1 * | 9/2003 | Furukawa et al. | 206/213.1 |
| 2007/0160408 | A1 * | 7/2007 | Peterson | 400/621 |

* cited by examiner

*Primary Examiner* — Anthony Stashick
*Assistant Examiner* — Elizabeth Volz
(74) *Attorney, Agent, or Firm* — Christine E. Parsons; Mark A. Hagedorn

(57) ABSTRACT

A packaging system is provided including a container having a plurality of walls and a flexible liner film placed in a product receiving chamber defined by the walls. The liner film comprises a base film having a first surface, a second surface and at least one side margin. A cold seal cohesive material layer is applied to the second surface of the base film so that at least a portion of at least one side margin of the base film is substantially free of cold seal cohesive material. A release film is laminated to the cold seal cohesive material layer and at least partially overlaps a portion of side margin substantially free of cold seal cohesive material.

41 Claims, 12 Drawing Sheets

LINER FILM AND PACKAGING SYSTEM WITH LINER FILM

BACKGROUND OF THE INVENTION

The present disclosure relates to packaging in general, and, more particularly, to packaging containers for accommodating an item or items in a secure manner. More particularly, the present disclosure relates to container liner films and packaging systems including liner films. Still more particularly, the present disclosure relates to container liner films comprising flexible polymeric films including a cold seal cohesive material layer and incorporating release films over the cold seal cohesive material layer. The liner films of the present disclosure may be incorporated in containers intended for shipping products to form packaging systems.

Various packaging boxes are known, including boxes equipped for shipping items in a secure manner. For instance, sensitive items are often shipped in boxes with the items supported on blocks or specially molded foamed polyurethane or spaced from the side panels of the box by cardboard inserts, foamed polyurethane pellets or beads, packaging "peanuts" or bubble-wrap sheets. These protective measures suppress the transmission to the items of impacts, shocks, vibrations and/or other forces to which the box itself may be subjected and prevent the items from substantial movement in the box during transport. However, they sometimes are bulky, costly, difficult to handle, environmentally undesirable, and/or non-compliant with or non-conforming to the items being shipped.

There remains a need for a user-friendly packaging system for packaging different sizes of products securely without the cost and hassle of prior protective measures.

BRIEF SUMMARY OF THE INVENTION

In one embodiment of the present disclosure, a packaging system is provided comprising (a) a container having a top wall, a bottom wall and a plurality of side walls, where the top wall, the bottom wall and each side wall has an interior surface; and (b) a flexible liner film that may be at least partially attached to the container at an interior surface of the bottom wall. The flexible liner film comprises a base film that may be attachable to the container. The base film has a first surface, a second surface and at least one side margin. The first surface of the base film may be adapted for attachment to the container. A cold seal cohesive material layer is applied to the second surface of the base film so that at least a portion of at least one side margin of the base film is substantially free of cold seal cohesive material. A release film is laminated to the cold seal cohesive material layer and at least partially overlaps a portion of side margin substantially free of cold seal cohesive material. The release film has a first surface and a second surface, and the release film first surface is adapted for releasable attachment to the cold seal cohesive material layer.

In another embodiment of the present disclosure, a packaging system is provided comprising (a) a container having a top wall, a bottom wall and a plurality of side walls, where the top wall, the bottom wall and each side wall has an interior surface; and (b) a flexible liner film that may be at least partially attached to the container at an interior surface of the bottom wall. The flexible liner film comprises a base film that may be attachable to the container. The base film has a first surface, a second surface and at least one side margin. The first surface of the base film may be adapted for attachment to the container. A cold seal cohesive material layer is applied to the second surface of the base film so that at least a portion of at least one side margin of the base film is substantially free of cold seal cohesive material. A release film is laminated to the cold seal cohesive material layer and at least partially overlaps a portion of side margin substantially free of cold seal cohesive material. The release film has a first surface and a second surface, and the release film first surface is adapted for releasable attachment to the cold seal cohesive material layer. In this embodiment, the base film optionally further may comprise an opening feature to provide assistance in opening a package formed by the flexible liner film.

In another embodiment of the present disclosure, a flexible liner film is provided. The flexible liner film comprises a base film that may be attachable to a container. The base film has a first surface, a second surface and at least one side margin. The first surface of the base film may be adapted for attachment to the container. A cold seal cohesive material layer is applied to the second surface of the base film so that at least a portion of at least one side margin of the base film is substantially free of cold seal cohesive material. A release film is laminated to the cold seal cohesive material layer and at least partially overlaps a portion of side margin substantially free of cold seal cohesive material. The release film has a first surface and a second surface, and the release film first surface is adapted for releasable attachment to the cold seal cohesive material layer.

In another embodiment, a flexible liner film is provided. The flexible liner film comprises a base film that may be attachable to a container. The base film has a first surface, a second surface and at least one side margin. The first surface of the base film may be adapted for attachment to the container. A cold seal cohesive material layer is applied to the second surface of the base film so that at least a portion of at least one side margin of the base film is substantially free of cold seal cohesive material. A release film is laminated to the cold seal cohesive material layer and at least partially overlaps a portion of side margin substantially free of cold seal cohesive material. The release film has a first surface and a second surface, and the release film first surface is adapted for releasable attachment to the cold seal cohesive material layer. In this embodiment, the base film optionally further may comprise an opening feature to provide assistance in opening a package formed by the flexible liner film.

The cold seal cohesive material of the present disclosure may be applied in different patterns. For instance, it may be applied over substantially the entire area of the second surface of the base film, excepting at least a portion of at least one side margin; or it may be applied in stripes over the second surface of the base film, again excepting at least a portion of at least one side margin.

DETAILED DESCRIPTION OF THE INVENTION

The present disclosure now will be described more fully with reference to the accompanying drawings, in which some but not all embodiments of the invention are shown. Indeed, the disclosure may be embodied in many different forms and should not be construed as limited to the embodiments set forth herein; rather, these embodiments are provided so that this disclosure will satisfy applicable legal requirements. Like numbers refer to like elements throughout.

Figure 1:
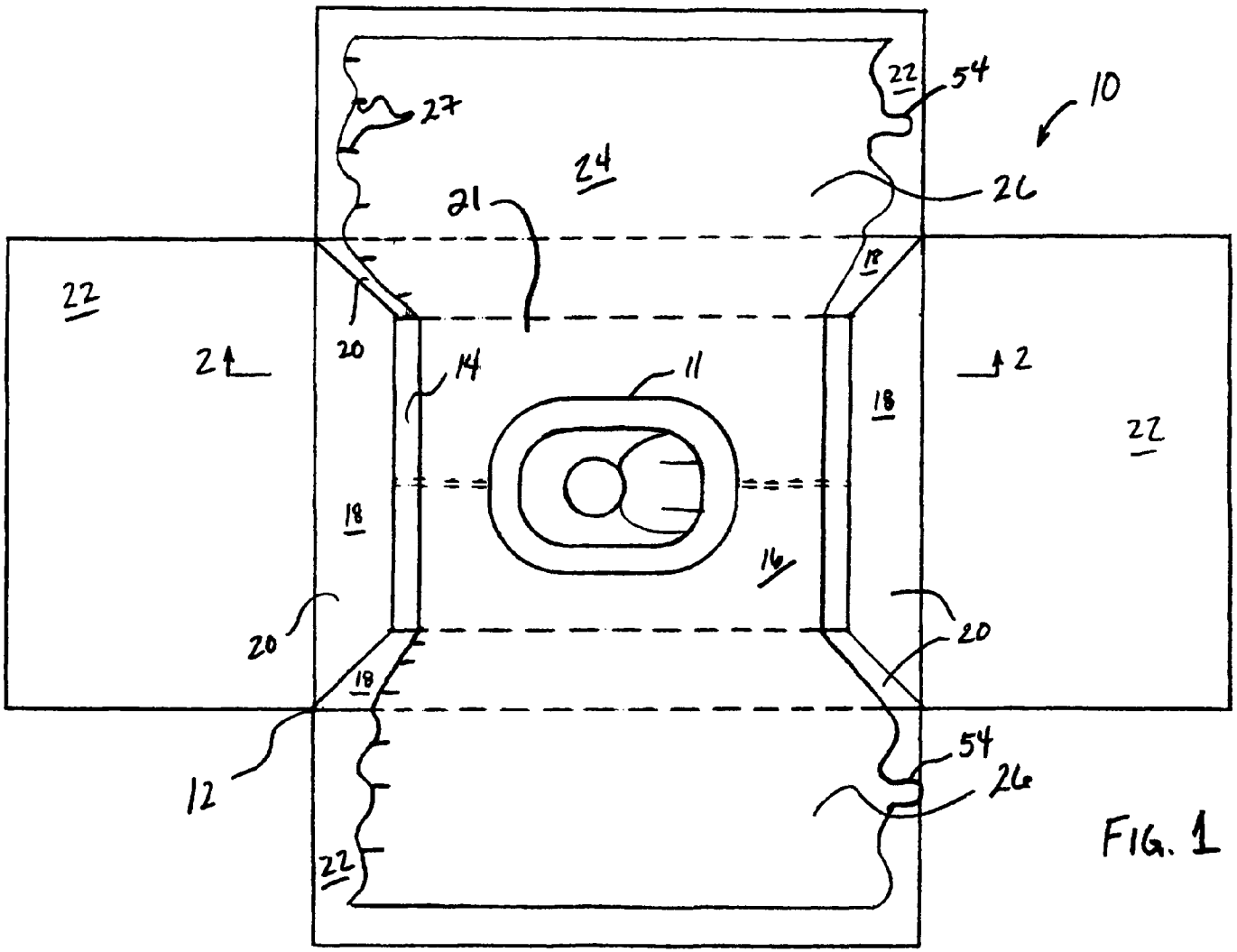
FIG. 1 is an illustration of a packaging system according to the present disclosure as viewed from above.

FIG. 1 illustrates a packaging system 10 according to the present disclosure viewed from above. The packaging system is used for packaging an article 11, such as a picture frame. The packaging system 10 includes a container 12 having a bottom wall 14. The container 12 may be manufactured from any suitable material, including card stock, corrugated paperboard, plastic sheet and the like. Preferably, the container is of a design that may be stored in a substantially flat condition and then converted into a useable container form. The bottom wall 14 includes an interior surface 16 (facing the viewer) and an exterior surface (not shown). The container 12 also includes a plurality of sidewalls 18 extending upwardly from the bottom wall 14, each side wall 18 including an interior surface 20. The bottom wall 14 and plurality of side walls define a product receiving chamber 21. The container 12 is shown in FIG. 1 with four side walls 18. However, one skilled in the art will appreciate that the container may take many forms and may include any number of side walls. Container 12 also includes a plurality of closure flaps 22 adapted for closing the container to form a top wall. Again, while four closure flaps 22 are shown in FIG. 1, one or more flaps may be used to close the container 12. Furthermore, the container 12 may be closed with a separate lid structure or film material secured thereto.

The packaging system 10 further includes a flexible liner film 24 that may be placed in the product receiving chamber 21 or attached to the interior surface of the bottom wall 14 of the container 12. The flexible liner film 24 may be attached to bottom wall 14 by any known means including adhesive and heat sealing. Preferably, the flexible liner film 24 is attached to the bottom wall 14 with a hot melt adhesive and is formed of a continuous sheet of film material (discussed in further detail below) supplied in roll form. In the embodiment shown in FIG. 1, the flexible liner film 24 includes first and second fold sections 26 overlying two side walls 18 and two closure flaps 22. First and second fold sections 26 are not attached to the container 12 bottom wall 14, side walls 18 or closure flaps 22 and are free to come together and be folded over and around the article 11. Preferably, the first and second fold sections 26 extend a length from the bottom wall 14 greater than the combined height of a side wall 18 and width of bottom wall 14. As such, the fold sections 26 are capable of coming together and being folded over and around an article substantially filling the container 12. In another embodiment, a single fold section 26 may be used, and such may have a length twice the combined height of a side wall 18 and width of bottom wall 14. Although the flexible liner film 24 is preferably a continuous sheet of film, two separate sheets of flexible liner film 24 may be attached to the bottom wall 14 with fold sections 26 extending therefrom.

In still another embodiment, the packaging system 10 may include a flexible liner film 24 having four fold sections 26, with one fold section 26 associated with each side wall 18. Again, it is preferred that the flexible liner film 24 is formed of a continuous sheet of film material. However, the flexible liner film 24 of this embodiment may be formed of two or more sheets of film that may be attached to the bottom wall 14.

Figure 2:
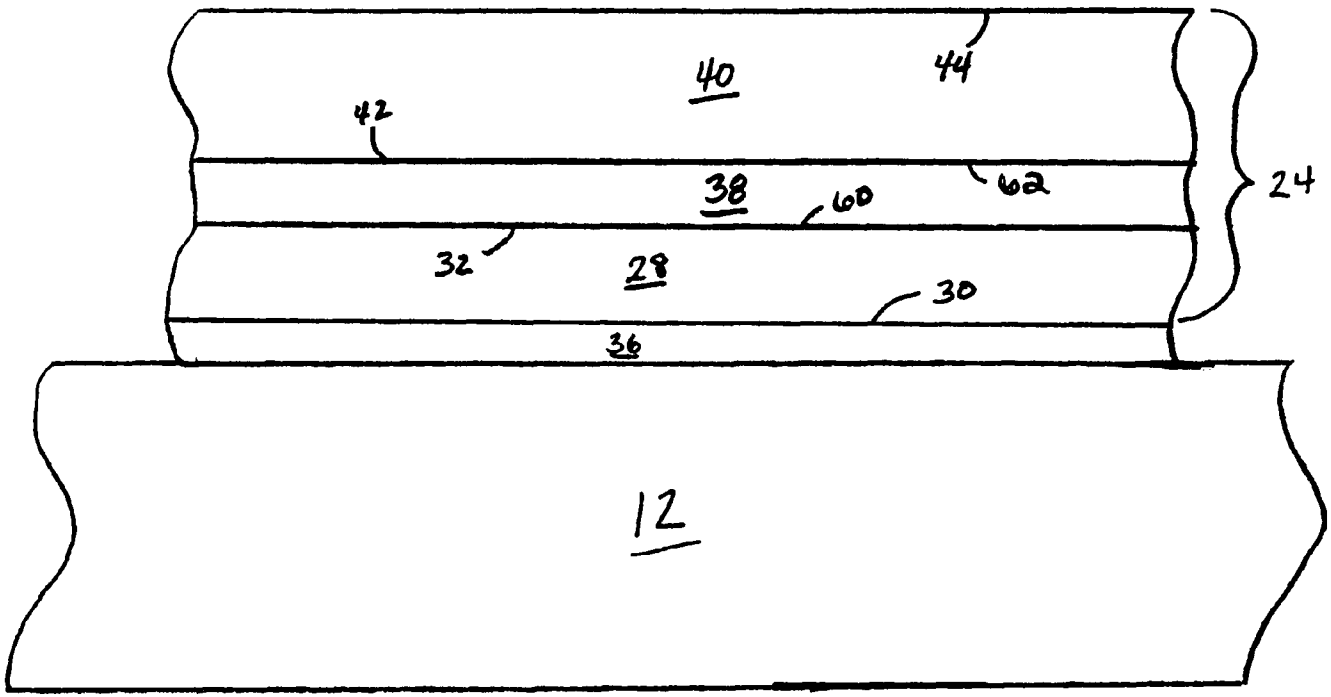
FIG. 2 is a partial cross-sectional view of the packaging system of FIG. 1 taken along line 2-2 of FIG. 1.

FIG. 2 is a partial cross-sectional view of the packaging system 10 taken along line 2-2 of FIG. 1. As shown in FIG. 2, flexible liner film 24 comprises a base film 28 having a first surface 30 and a second surface 32. The first surface 30 of base film 28 may be at least partially attached to container 12, shown here by an adhesive layer 36. The first surface 30 is preferably attached to the bottom wall 14 and is not secured to the side walls 18 so that portions of the flexible liner film 24 may be positioned over and around the article 11 to be contained. The second surface 32 of base film 28 is coated with a cold seal cohesive material layer 38. The cold seal cohesive material layer 38 has a first surface 60 and a second surface 62. A release film 40 having a first surface 42 and a second surface 44 covers and protects the cold seal cohesive material layer 38 prior to use. Prior to use, the cold seal cohesive material layer 38 also functions as an adhesive layer between the base film 28 and the release film 40.

The packaging system 10 is used as follows. The user peels and removes the release film 40 from the cold seal cohesive material layer 38 to expose the second surface 62 of the cold seal cohesive material layer 38. The article 11 is placed in the container 12 and rests on the exposed cold seal cohesive material layer 38 at the interior surface of the bottom wall 14. Opposing fold sections 26 are brought together so that the second surfaces 62 of the cold seal cohesive material layer 38 are sealed together, and the sealed resulting film is wrapped around the article 11. Alternatively, opposing fold sections 26 may be overlapped so that the second surface of the cold seal cohesive material layer 38 is sealed with the first surface 30 of the base film 28, and the sealed resulting film is wrapped around the article 11. Whether the fold sections 26 are brought together or overlapped, the article 11 is securely retained in the product receiving chamber 21 during shipping without the use of packaging "peanuts," bubble wrap or the like.

The base film 28 may be selected from polymeric film materials having puncture resistance, including but not limited to polyethylene, ionomer, polypropylene, nylon or polyester films. One non-limiting example of a base film is liner low density polyethylene (LLDPE) (such as 22A640 available from Bemis Company Polyethylene Packaging Division (Terre Haute, Ind.)). The thickness of the base film 28 is preferably from about 0.5 mil to about 10.0 mil, more preferably from about 1.5 mil to about 7.5 mil, and still more preferably from about 2.0 mil to about 4.0 mil, although thinner and thicker films may be used. The base film 28 may be selected from monolayer and multilayer films, including coextrusions and laminations. The base film 28 is preferably selected from film materials capable of forming strong bonds with a hot melt adhesive and strong seals with the cold seal cohesive material layer 38. The base film 28 is selected to have a seal strength with the cold seal cohesive material layer 38 greater than the bond strength of the cold seal cohesive material layer 38 with the release film 40. Preferably, the seal strength between the base film 28 and the cold seal cohesive material layer 38 is from about 100 grams per inch to about 1500 grams per inch, more preferably from about 300 grams per inch to about 600 grams per inch.

The base film 28 may be treated, such as by corona treatment, on its second surface 32 to promote cold seal cohesive material adhesion. The first surface 30 of the base film 28 may also be treated to promote the optional attachment of the base film 28 to the bottom wall 14 of the container 12 or to promote the cold seal cohesive material adhesion when opposing fold sections 26 are overlapped in use so that a strong seal is formed between the second surface 62 of the cold seal cohesive material layer 38 and the first surface 30 of the base film 28. The base film 28 may include other additives, including but not limited to corrosion inhibitors, antioxidants, flame retardants and pigments. The first surface 30 and/or second surface 32 of the base film 28 may be printed with indicia, such as holiday theme indicia or other desirable designs. The base film 28 may also be free of or have low loading levels of additives that may negatively interact with the adhesion of the cold seal cohesive material layer 38.

The base film 28 may include an opening feature, such as a tear notch 27 (as illustrated in FIG. 1). The opening feature may be selected from known opening features such as notches, pull tabs, score lines, tear initiation techniques, combinations of the foregoing, etc. Multiple opening features may be incorporated into the base film, such as the multiple tear notches 27 illustrated along a side edge of the fold sections 26 in FIG. 1. Multiple opening features will more likely provide an opening feature in an accessible portion of the flexible liner film 24 upon wrapping about different sizes of articles. As such, one or more opening features may be located within an area of the sealed liner film that a user may access to assist in removing the sealed liner film from the article.

The cold seal cohesive material layer 38 may be selected from natural latex-based cold seal cohesive materials or synthetic cold seal cohesive materials. Synthetic cold seal cohesive materials may be preferred due to the risk of allergic reaction for individuals sensitive to natural latex-based materials. However, natural latex-based cold cohesive materials may be used in appropriate circumstances. The cold seal cohesive material is selected to form a strong seal with base film 28 and a lesser bond with release film 40 to enable release film 40 to be easily peeled away from the cold seal cohesive material layer 38 and to retain such seal and bond properties over long storage periods. The cold seal cohesive material should also form a cohesive seal with itself. Non-limiting examples of cold seal cohesive materials include the following: C2978 (natural latex-based acrylic emulsion reportedly having a density of 8.1 lb/gal at 77° F., a viscosity of 85 cPs Brookfield at 77° F. and a pH of 10.2), C7211 (synthetic acrylic emulsion reportedly having a density of 9.51 lb/gal at 77° F., a viscosity of 90 cPs Brookfield at 77° F. and a pH of 11.0) and C7180 (synthetic acrylic emulsion reportedly having a density of 8.6 lb/gal at 77° F., a viscosity of 200 cPs Brookfield at 77° F. and a pH of 9.9) all available from Bostik, Inc. (Wauwatosa, Wis.); Primaseal® 39-01-1 (water-based, synthetic latex reportedly having a weight per gallon of 9.1 lb/gal at 68° F., a Zahn #2 cup viscosity of 24 cps at 77° and a pH of 10.0) available from Henkel Corporation (Gulph Mills, Pa.); and Coseal™ 55×300 (water-based, synthetic polymer reportedly having a density of 1.03 g/cm$^3$, a viscosity of 50-150 cps at 77° F. and a pH of 7.4-9.0) available from Rohm and Haas Company (Philadelphia, Pa.).

The cold seal cohesive material is applied to the base film 28 using an acceptable method, such a gravure press coating, smooth roll coating, spray coating, air knife coating or Meyer rod coating. The cold seal cohesive material is preferably coated on the base film 28 in a range of from about 1.0 pounds per ream to about 6.0 pounds per ream, more preferably from about 2.0 pounds per ream to about 4.0 pounds per ream. The cold seal cohesive material may be applied in different patterns.

Figure 3:
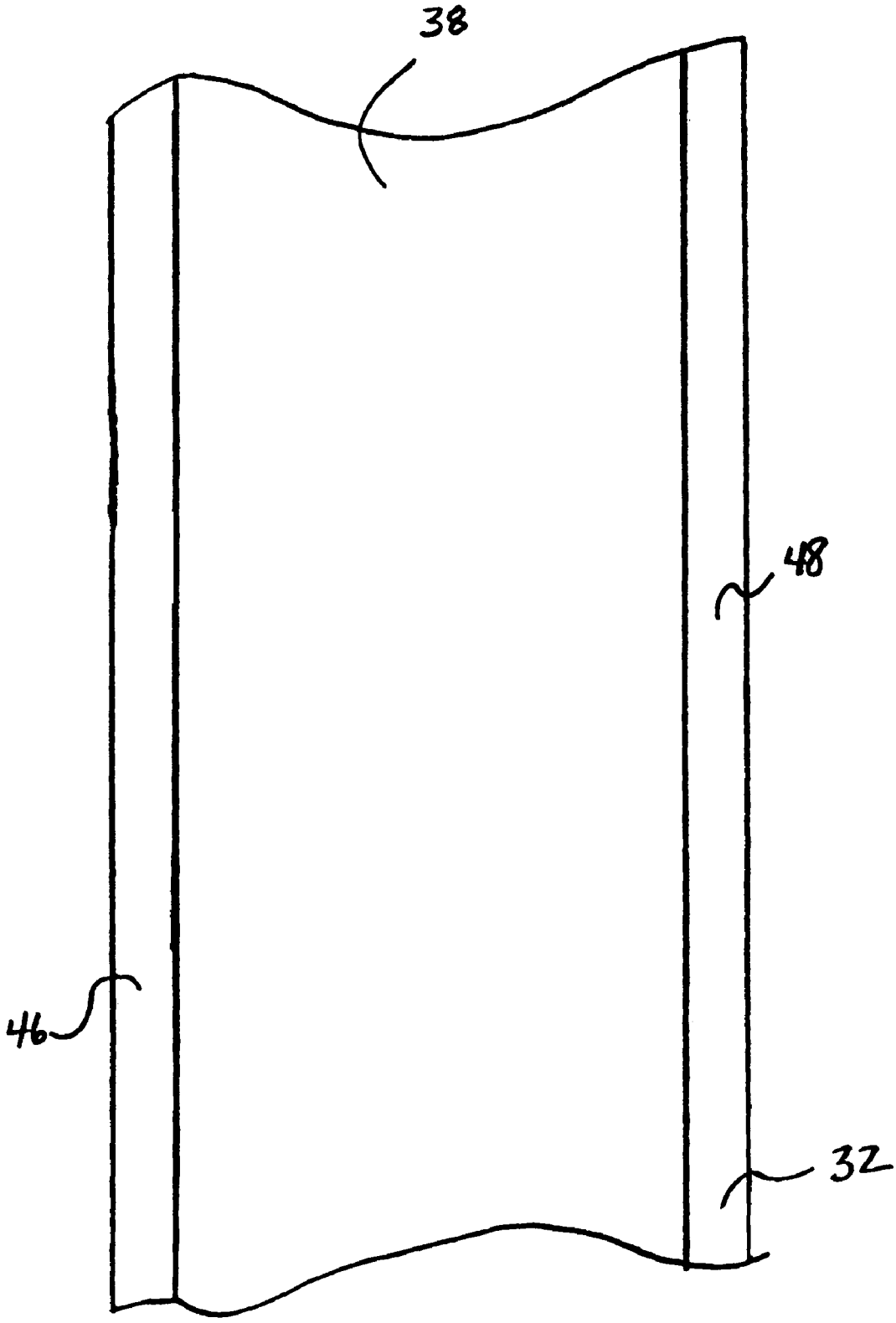
FIG. 3 is a top view of one pattern of application of cold seal cohesive material of the present disclosure showing a substantially complete cold seal coverage of an embodiment with two side margins.

FIG. 3 illustrates one pattern of cold seal cohesive material application. In FIG. 3, the cold seal cohesive material is coated over substantially the entire second surface 32 of the base film 28; however, first and second side margins 46 and 48 are left free of cold seal cohesive material. The resulting cold seal cohesive material layer 38 extends continuously between first and second side margins 46 and 48. First and second side margins 46 and 48 (or a single side margin) may be any width desired but are preferably from about ⅛ inch to about ½ inch in width. First and second side margins 46 and 48 (or a single side margin) provide a "dry" area of base film 28 that will not adhere to the release film 40 since the cold seal cohesive material layer 38 is absent. As such, the end user can more easily manually grip the side edges of the base film 28 and the release film 40 at a point of overlap and peel the release film 40 to expose the cold seal cohesive material layer 38.

Figure 4:
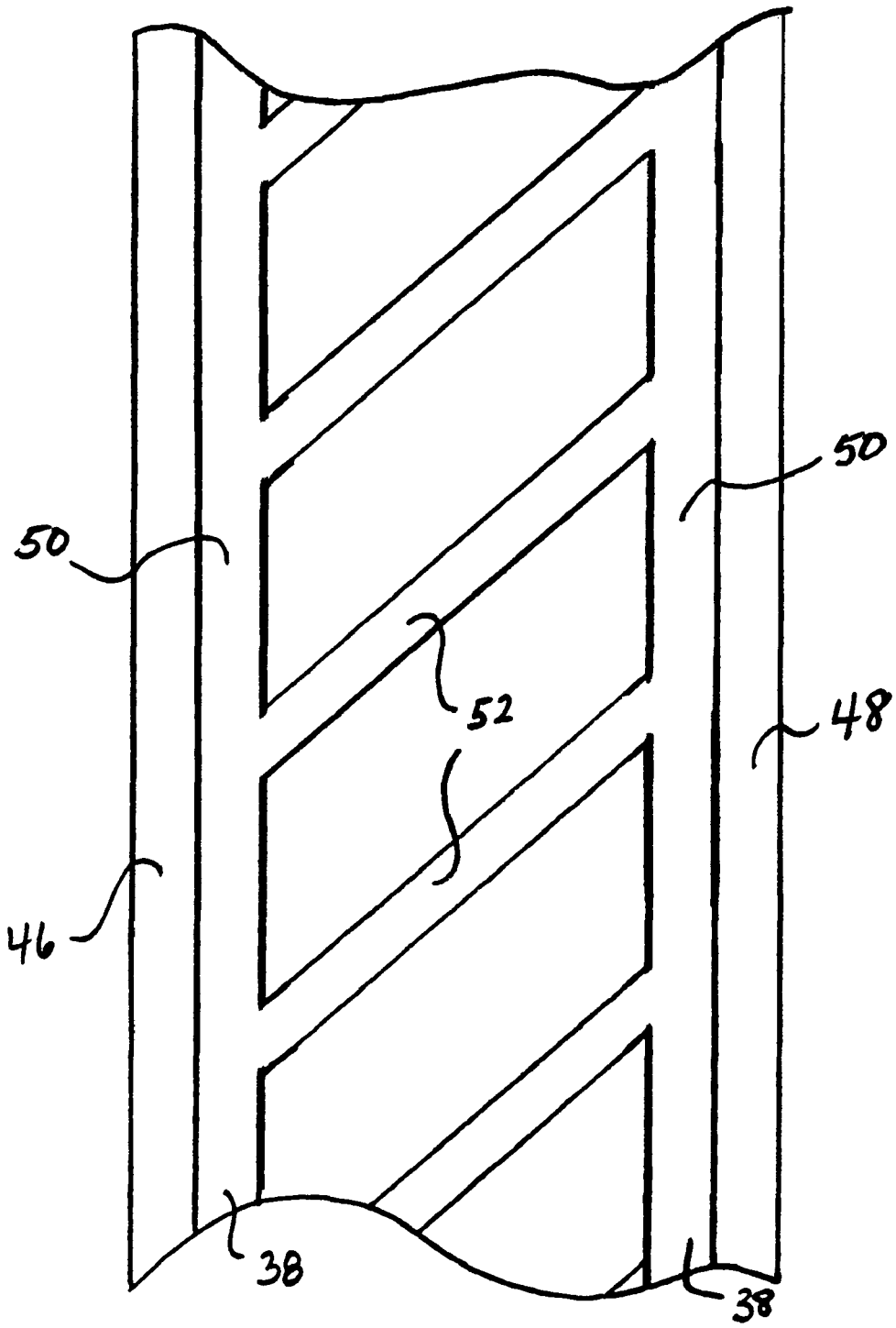
FIG. 4 is a top view of another pattern of application of cold seal cohesive material of the present disclosure showing a striped cold seal coverage of an embodiment with two side margins.

FIG. 4 illustrates another pattern of cold seal cohesive material application. In FIG. 4, the resulting cold seal cohesive material layer 38 includes two substantially parallel longitudinal stripes 50 running continuously in the machine direction and a plurality of repeating crossing stripes 52 transversely interconnecting the longitudinal stripes 50. First and second side margins 46 and 48 are again left free of cold seal cohesive material.

Although two patterns of cold seal cohesive material layer 38 are shown, one skilled in the art will appreciate that any desired pattern may be utilized so long as at least a portion of one side margin of the base film 28 is left substantially free of cold seal cohesive material and sufficient cold seal cohesive material is used to secure the article 11. Adjusting the total amount of cold seal cohesive material coverage allows the manufacturer to modify the ultimate cold seal cohesive material seal strength, may provide for easier product release from the packaging system, and allows cost savings in reduced cold seal cohesive material consumption and drying requirements.

Returning to FIG. 2, the release film 40 is selected from flexible film materials that form a releasable bond with the cold seal cohesive material layer 38. In this regard, the first surface 42 of release film 40 is selected to have a bond strength with the cold seal cohesive material layer 38 less than the internal cohesive seal strength (also known as "guts") of the cold seal cohesive material layer 38 and the seal strength of cold seal cohesive material layer 38 with the base film 28. The release film 40 is selected to have a thickness of from about 0.3 mil to about 10.0 mil, preferably from about 1.0 mil to about 5.0 mil, more preferably from about 1.5 mil to about 4.0 mil. The release film 40 may be selected from any material with release properties, including but not limited to polypropylene, polyethylene, polyester, polystyrene, polyvinyl chloride, release-coated materials (including but not limited to release-coated papers and release-coated polymeric films), and coextrusions and laminations thereof.

In one embodiment, the release film 40 comprises a lamination including an oriented polypropylene (OPP) film (such as RLS, a transparent, non-sealable, slip-modified, coextruded, biaxially OPP film available from AET Films, Inc. (New Castle, Del.) or Bicor® CSR-2, a one-side treated OPP film with a slip-modified layer available from ExxonMobil Chemical Company (Macedon, N.Y.)). The OPP film is laminated with an adhesive (such as Avadyne® AV1254+Avadyne® CA100 available from Henkel Corporation (Gulph Mills, Pa.)) to a LLDPE film (such as 22A640 available from Bemis Company Polyethylene Packaging Division (Terre Haute, Ind.)). In this embodiment, the OPP film forms the first surface 42 of the release film 40 and the LLDPE forms the second surface 44 of the release film 40.

In another embodiment, the release film 40 comprises a LLDPE film having a release lacquer (such as Sun SD00383F/B available from Sun Chemical Corporation (Northlake, Ill.)) coated over a surface of the LLDPE such that the release lacquer forms the first surface 42 of the release film 40 and the LLDPE forms the second surface 44 of the release film 40.

In yet another embodiment, the release film 40 comprises a LLPDE film forming both the first and second surfaces 42 and 44 of the release film 40.

The release film 40 may be printed with indicia, as with the base film 28. Preferably, the second surface 44 of release film 40 is printed with indicia. The release film 40 may also include a pull tab 54 (as illustrated in FIG. 1) extending laterally from a side edge of the flexible liner film 24. In this instance with the pull tab 54, a portion of the release film 40 would extend laterally beyond a side edge of the base film 28 to provide a portion for the user to peel the release film 40 from the cold seal cohesive material layer 38.

The release film 40 is selected to have a width great enough to cover the cold seal cohesive material layer 38 on the base film 28 and at least partially overlap a portion of the base film 28 side margin substantially free of cold seal cohesive material. Preferably, the release film 40 is substantially of equal width to the width of the base film 28 so that overlap of the release film 40 with a portion of a "dry" portion of a side margin occurs.

The cold seal cohesive material layer 38 and the release film 40 are selected to substantially maintain their adhesive/cohesive properties and release properties, respectively, over extended periods of storage. It is important that the peel force required to remove the release film 40 from the cold seal cohesive material layer 38 not significantly increase over time. In addition to becoming more difficult for the user to remove the release film 40, if the peel force required to remove the release film 40 increases beyond the seal strength between the cold seal cohesive material layer 38 and the base film 28 or the cohesive seal internal to the cold seal cohesive material layer 38, the cold seal cohesive material will release from the base film 28 or cohesively fail. Such failures can lead to substantially no cold seal on the base film 28 and substantially less cold seal cohesive material layer 38 thickness than desired for firm retention of the article 11. Preferably, the peel force required to remove the release film 40 is maintained in a range of from about 0 grams per inch to about 100 grams per inch, more preferably in a range of from about 10 grams per inch to about 40 grams per inch.

The flexible liner film 24 may be constructed in the following manner: The base film 28 of a desired width is provided. The desired cold seal cohesive material is applied in a desired pattern to the base film 28 to form the cold seal cohesive material layer 38. The release film 40 is constructed (if a multilayer construction) and is then laminated to the base film 28/cold seal cohesive material layer 38 construction such that the first surface 42 of the release film 40 contacts cold seal cohesive material layer 38. A portion of a side margin of the base film 28 free of cold seal cohesive material provides the user access to the release film 40 such that the release film 40 may be peeled away to expose the cold seal cohesive material layer 38. The flexible liner film 24 is preferably manufactured in roll form with the cold seal cohesive material extending substantially continuously in the machine direction. The packaging system of the present disclosure is constructed by placing the flexible liner film 24 in an interior surface of the container 12, preferably against the bottom wall 14; the flexible liner film 24 may also be attached to the bottom wall 14. The flexible liner film 24 is then severed from the roll and the next container is provided with flexible liner film 24. Optionally, the flexible liner film 24 may be pre-cut in appropriate lengths and the individual lengths then placed in or attached to containers.

The following examples are intended solely to illustrate the present disclosure and are not to be construed as limiting the scope of the attached claims. Exemplary flexible liner films according to the present disclosure were constructed and tested for bond strength and/or seal strength over time. Bond strength (also known as "blocking force") is defined as the force required to separate the release film from the cold seal cohesive material layer. Seal strength is defined as the force required to separate the cold seal cohesive material from the base film or from itself.

Examples 1-3

The flexible liner film of Example 1 comprises a base film comprising 4.0 mil LLDPE with C2978 natural latex-based cold seal cohesive material applied on a surface of the base film. A release film comprising 60 gauge OPP adhesively laminated to 1.5 mil LLDPE is laminated to the base film/cold seal construction such that the 60 gauge OPP layer of the release film contacts the cold seal cohesive material.

The flexible liner film of Example 2 comprises a base film comprising 4.0 mil LLDPE with C2978 natural latex-based cold seal cohesive material applied on a surface of the base film. A release film comprising 2.0 mil LLDPE coated with Sun SD00383F/B release lacquer is laminated to the base film/cold seal construction such that the release lacquer layer of the release film contacts the cold seal cohesive material.

The flexible liner film of Example 3 comprises a base film comprising 4.0 mil LLDPE with C7180 synthetic cold seal cohesive material applied on a surface of the base film. A release film comprising 60 gauge OPP adhesively laminated to 1.5 mil LLDPE is laminated to the base film/cold seal construction such that the 60 gauge OPP layer of the release film contacts the cold seal cohesive material.

Figure 5:
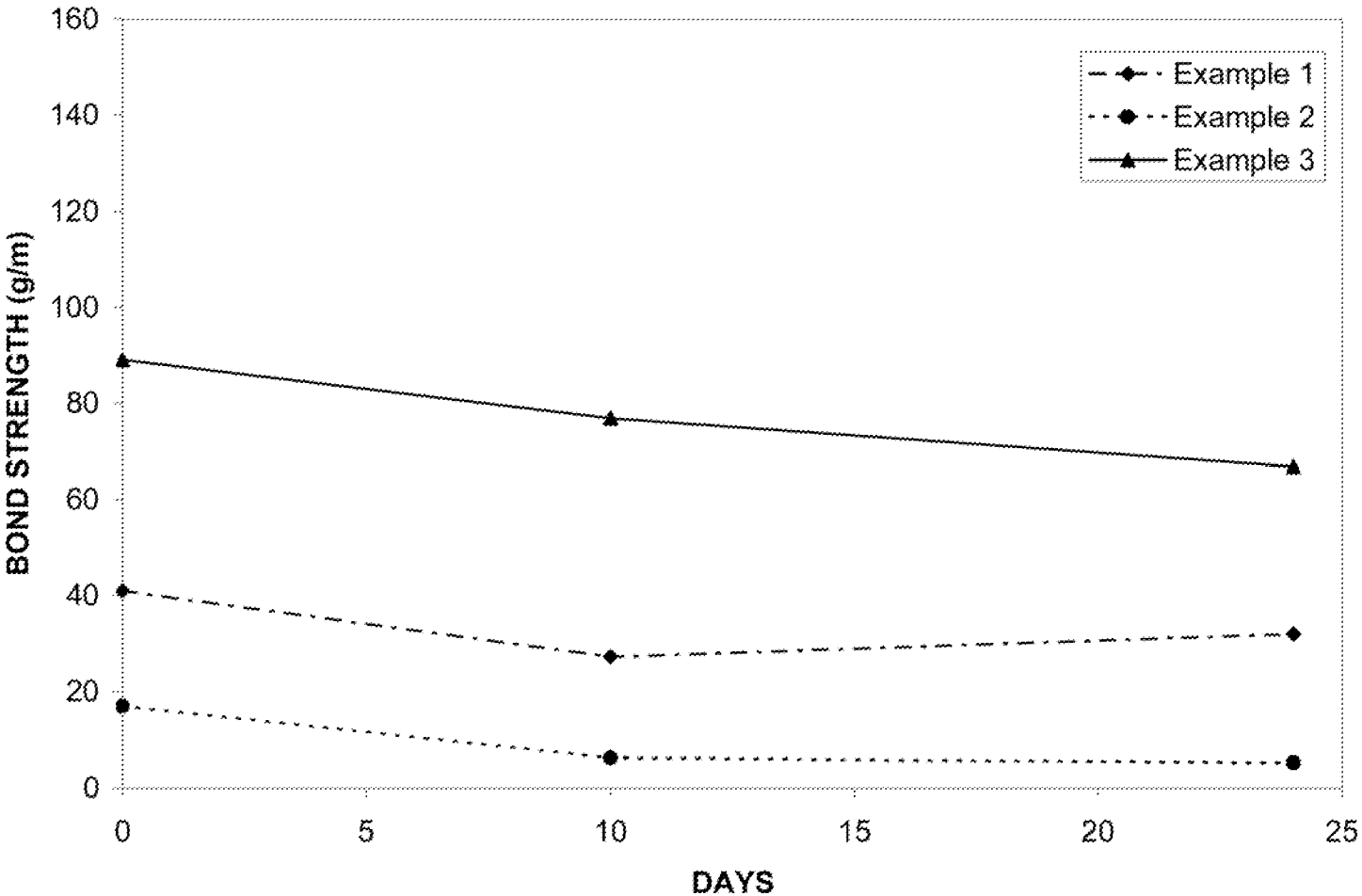
FIG. 5 is a graphical representation of bond strength between cold seal cohesive material and release film over time under ambient conditions (70° F., 50% relative humidity) for the embodiments of Examples 1-3.
Figure 6:
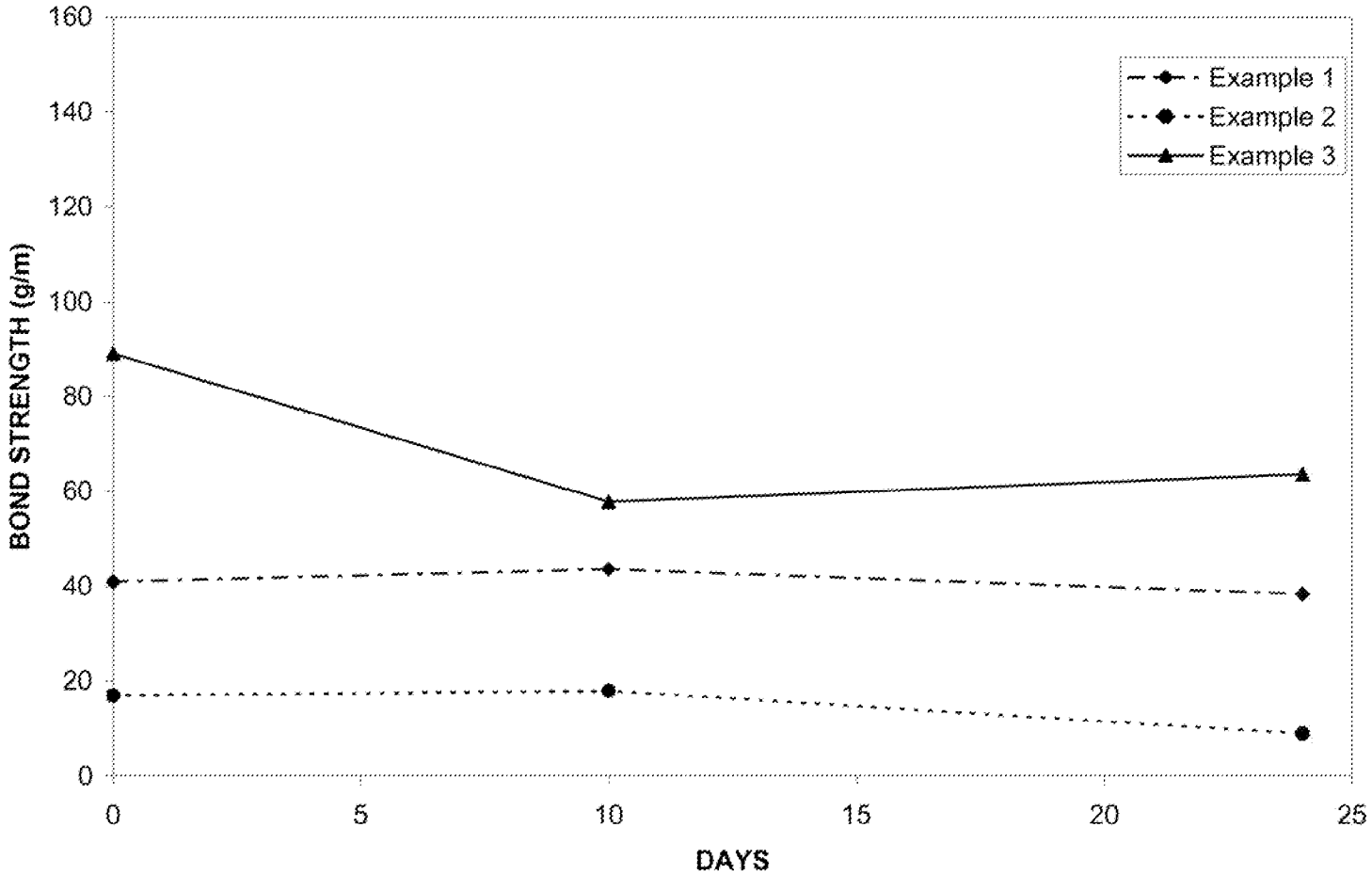
FIG. 6 is a graphical representation of bond strength between cold seal cohesive material and release film over time under desert conditions (120° F., unregulated humidity) for the embodiments of Examples 1-3.
Figure 7:
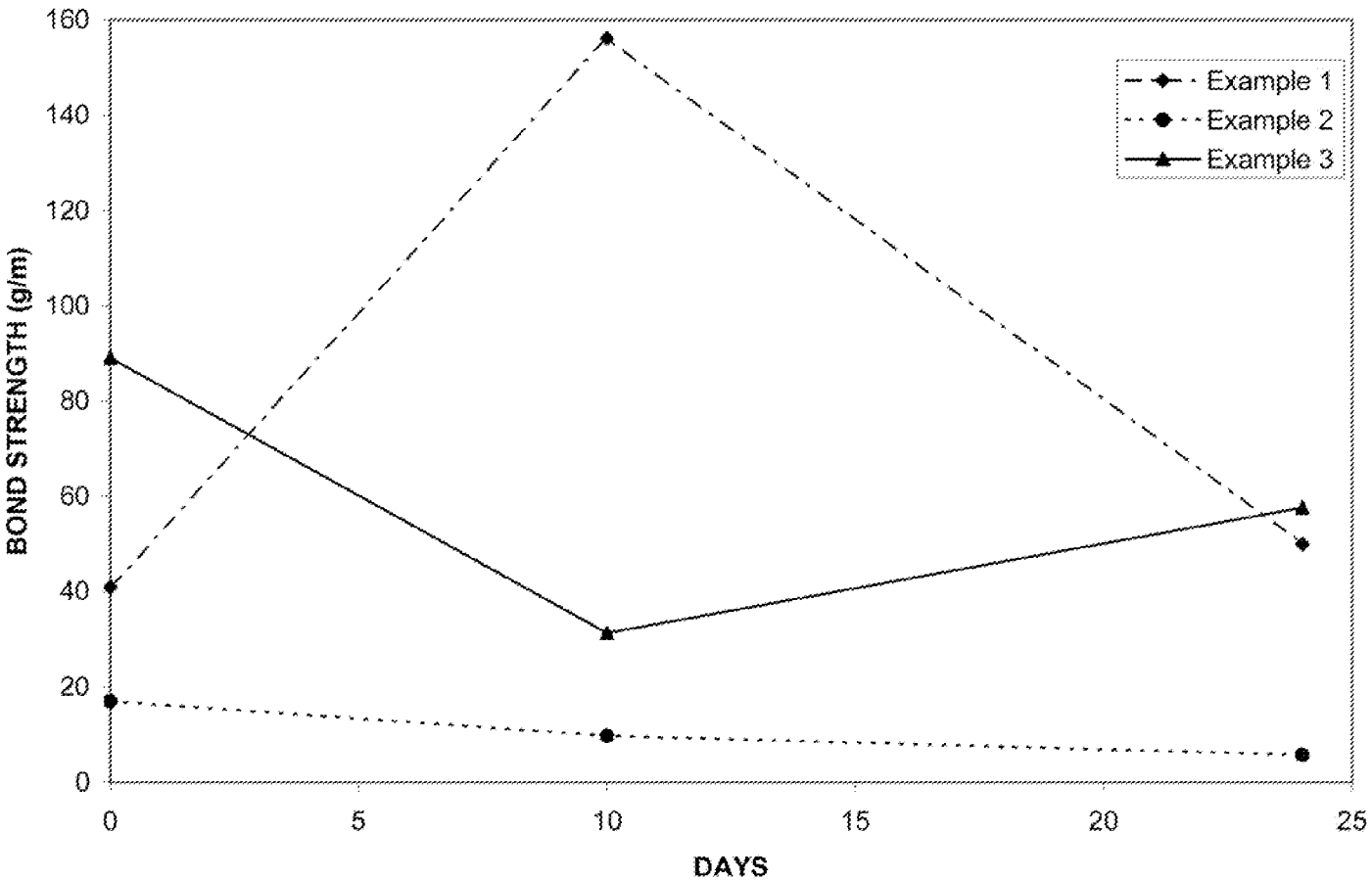
FIG. 7 is a graphical representation of bond strength between cold seal cohesive material and release film over time under jungle conditions (100° F., 90% relative humidity) for the embodiments of Examples 1-3.

As shown in FIG. 5, at ambient conditions (70° F., 50% relative humidity) the synthetic cold seal cohesive material layer of Example 3 exhibited an increased bond strength compared to the natural latex-based cold seal cohesive material layers of Examples 1 and 2 but does not increase such bond strength at a period of greater than twenty days. FIG. 6 illustrates that, at desert conditions (120° F., unregulated humidity), the bond strength of the synthetic cold seal cohesive material layer of Example 3 decreased over time. FIG. 7 shows that, at jungle conditions (100° F., 90% relative humidity), the synthetic cold seal cohesive material layer of Example 3 exhibited a bond strength only slightly greater than the natural latex-based cold seal cohesive material layers of Examples 1 and 2 at a period of greater than twenty days.

Figure 8:
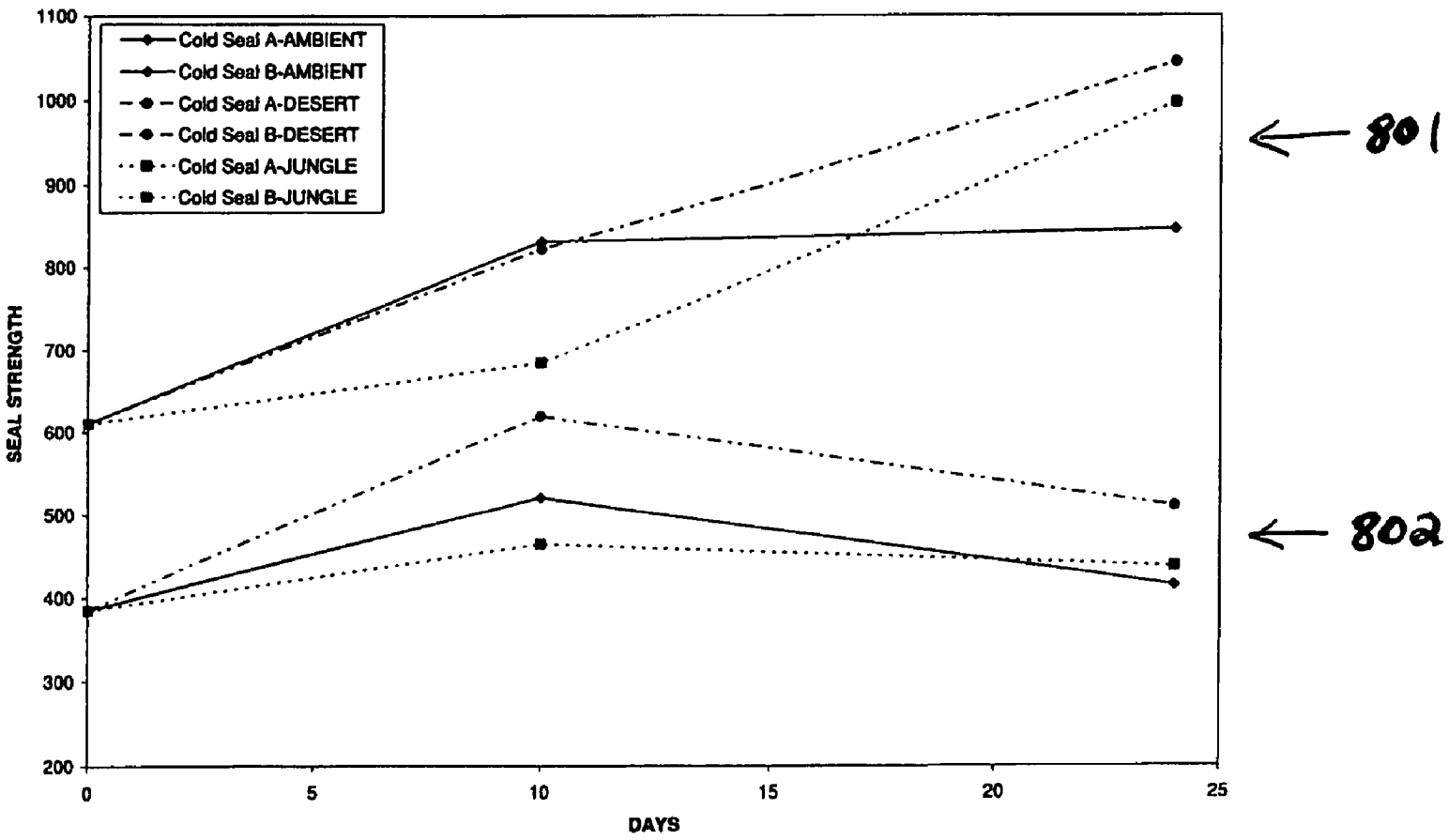
FIG. 8 is a graphical representation of seal strength between cold seal cohesive material and base film over time under ambient, desert and jungle conditions for a natural latex-based cold seal cohesive material and a synthetic cold seal cohesive material.

In FIG. 8, Cold Seal A is a natural latex-based cold seal cohesive material, and Cold Seal B is a synthetic cold seal cohesive material. The seal strengths for Cold Seal A at ambient, desert and jungle conditions over time group together at 801. The seal strengths for Cold Seal B at ambient, desert and jungle conditions group together at 802. FIG. 8 shows that the natural latex-based cold seal cohesive material layer maintains a higher seal strength over time and that the synthetic cold seal cohesive material layer maintains a substantially consistent seal strength over time.

Example 4

Figure 9:
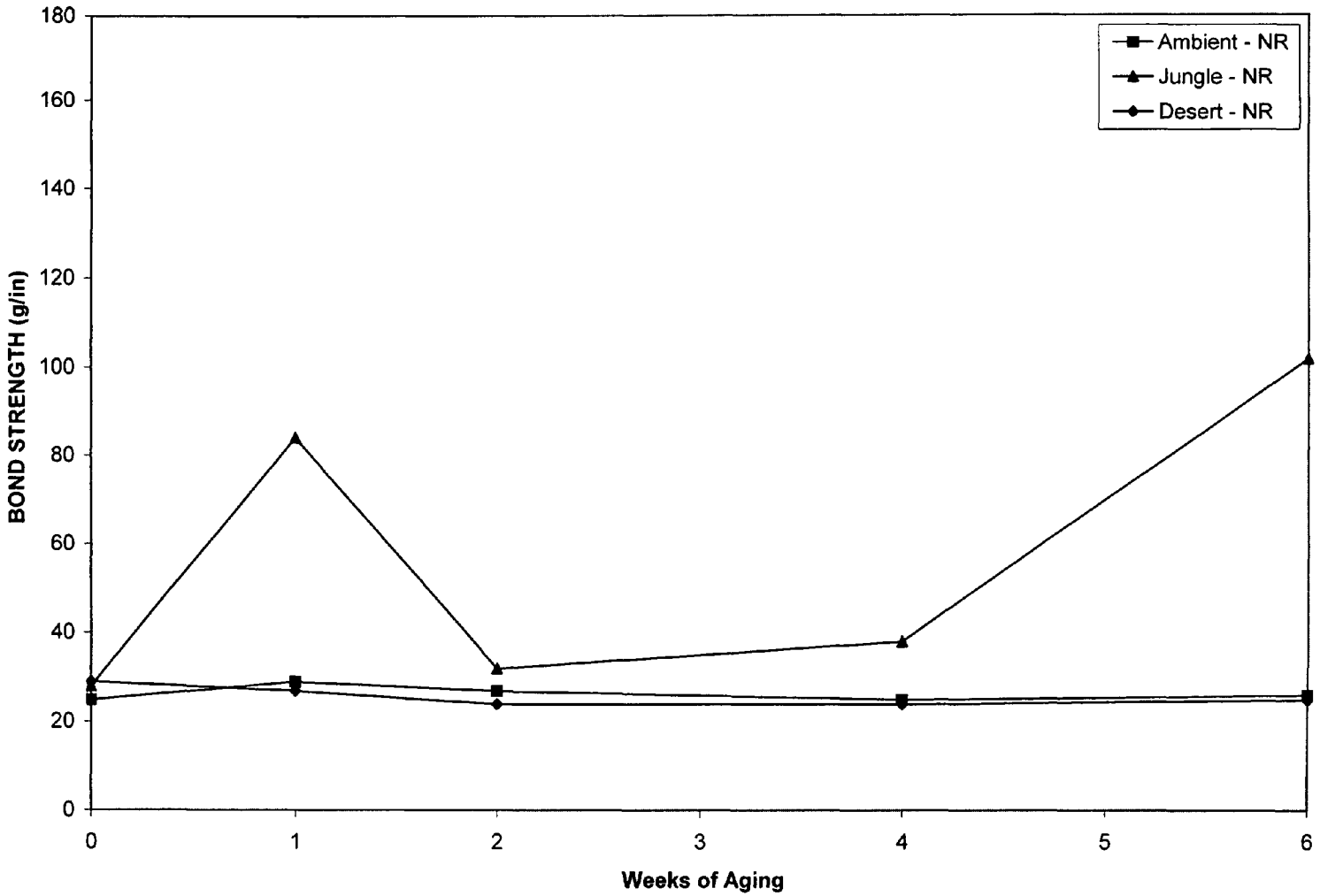
FIG. 9 is a graphical representation of bond strength between cold seal cohesive material and release film over time under ambient, jungle and desert conditions for the embodiment of Example 4.

The flexible liner film of Example 4 comprises a base film comprising LLDPE with natural latex-based cold seal cohesive material applied on a surface of the base film. A release film comprising OPP adhesively laminated to LLDPE is laminated to the base film/cold seal construction such that the OPP layer of the release film contacts the cold seal cohesive material. FIG. 9 shows the bond strength of the natural latex-based cold seal cohesive material layer of Example 4 at ambient, jungle and desert conditions over time.

Example 5

Figure 10:
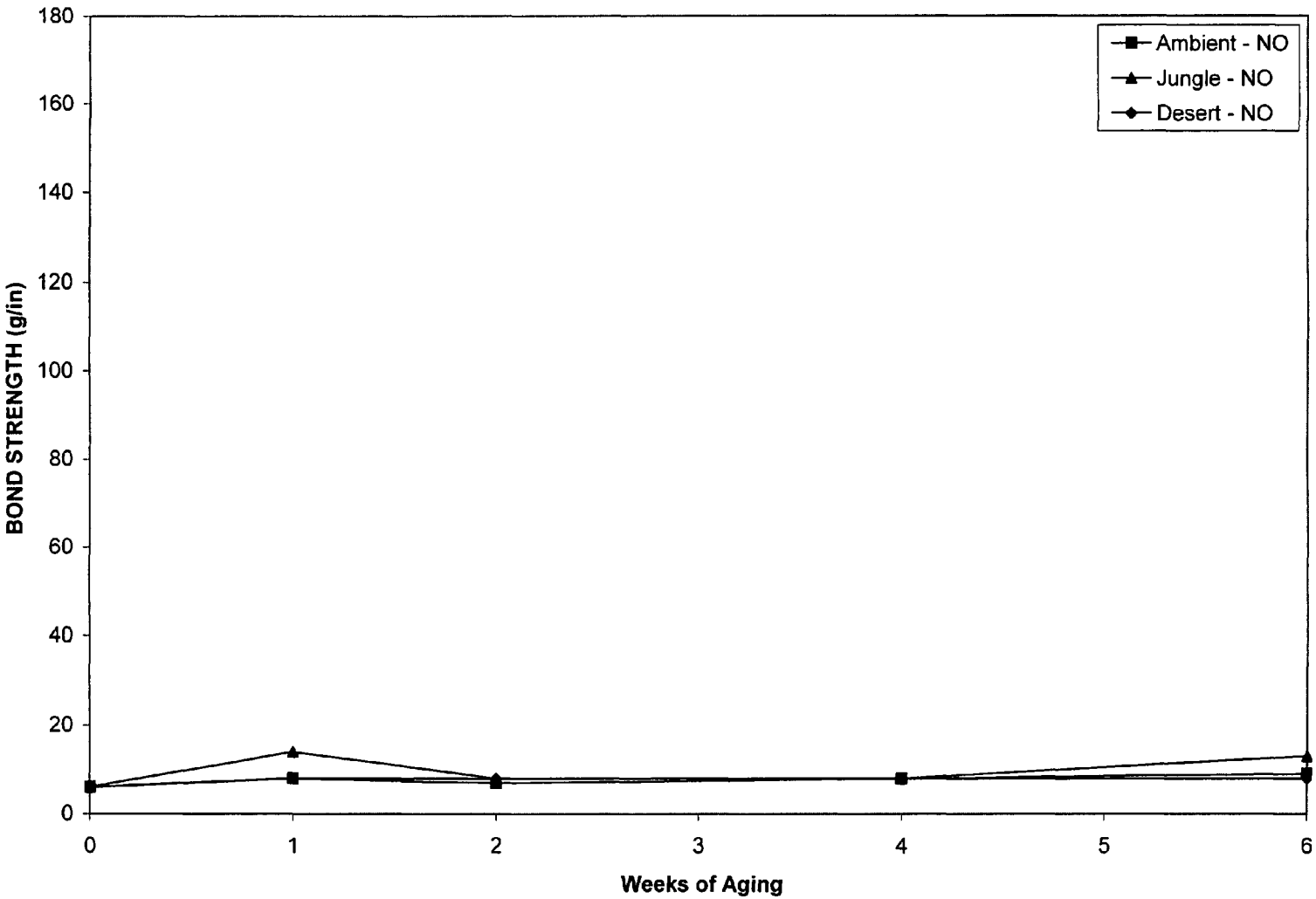
FIG. 10 is a graphical representation of bond strength between cold seal cohesive material and release film over time under ambient, jungle and desert conditions for the embodiment of Example 5.

The flexible liner film of Example 5 comprises a base film comprising LLDPE with natural latex-based cold seal cohesive material applied on a surface of the base film. A release film comprising LLDPE coated with a release lacquer is laminated to the base film/cold seal construction such that the release lacquer layer of the release film contacts the cold seal cohesive material. FIG. 10 shows the bond strength of the natural latex-based cold seal cohesive material layer of Example 5 at ambient, jungle and desert conditions over time.

Example 6

Figure 11:
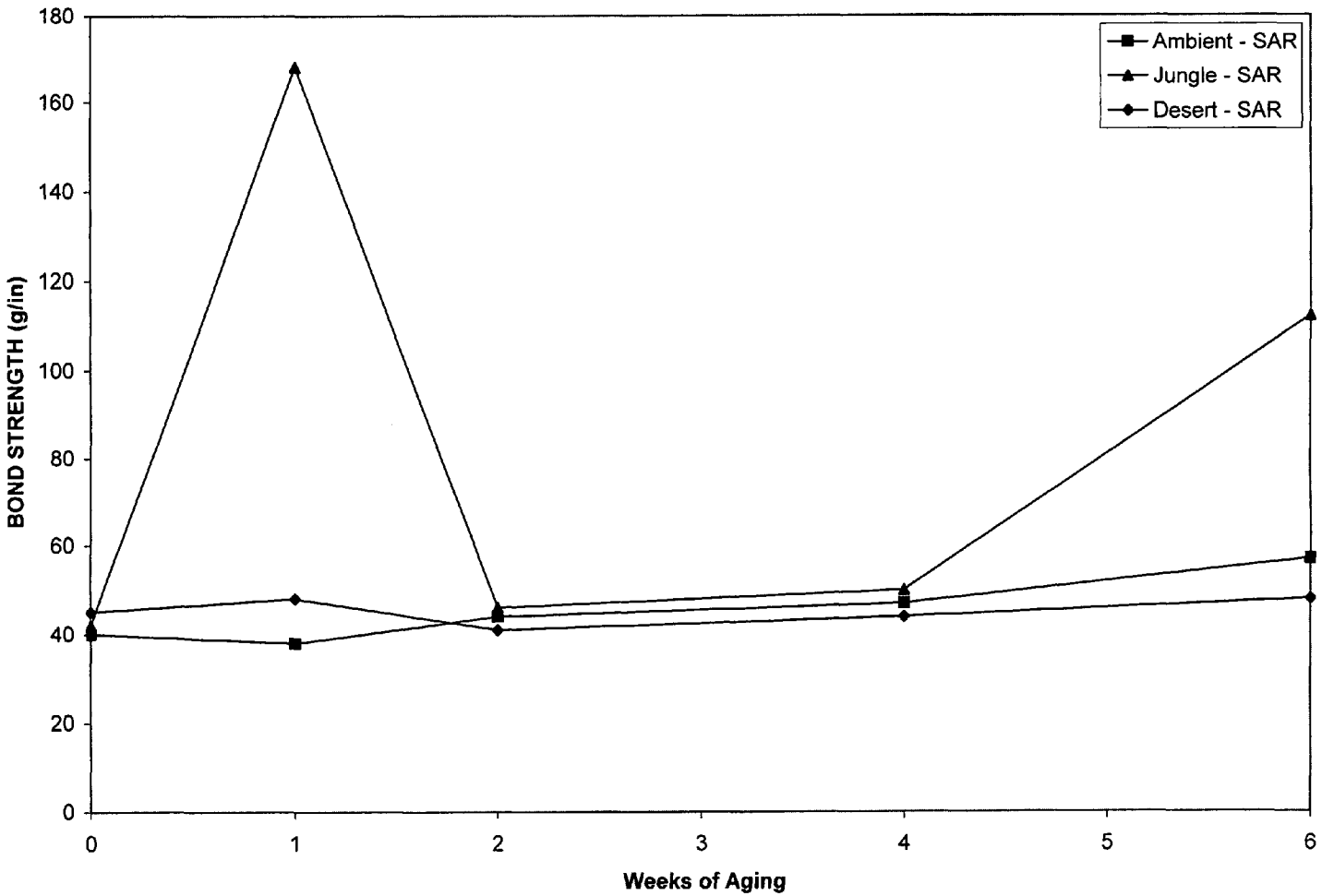
FIG. 11 is a graphical representation of bond strength between cold seal cohesive material and release film over time under ambient, jungle and desert conditions for the embodiment of Example 6.

The flexible liner film of Example 6 comprises a base film comprising LLDPE with Primaseal® 39-01-1 synthetic cold seal cohesive material applied on a surface of the base film. A release film comprising OPP adhesively laminated to LLDPE is laminated to the base film/cold seal construction such that the OPP layer of the release film contacts the cold seal cohesive material. FIG. 11 shows the bond strength of the synthetic cold seal cohesive material layer of Example 6 at ambient, jungle and desert conditions over time.

Example 7

Figure 12:
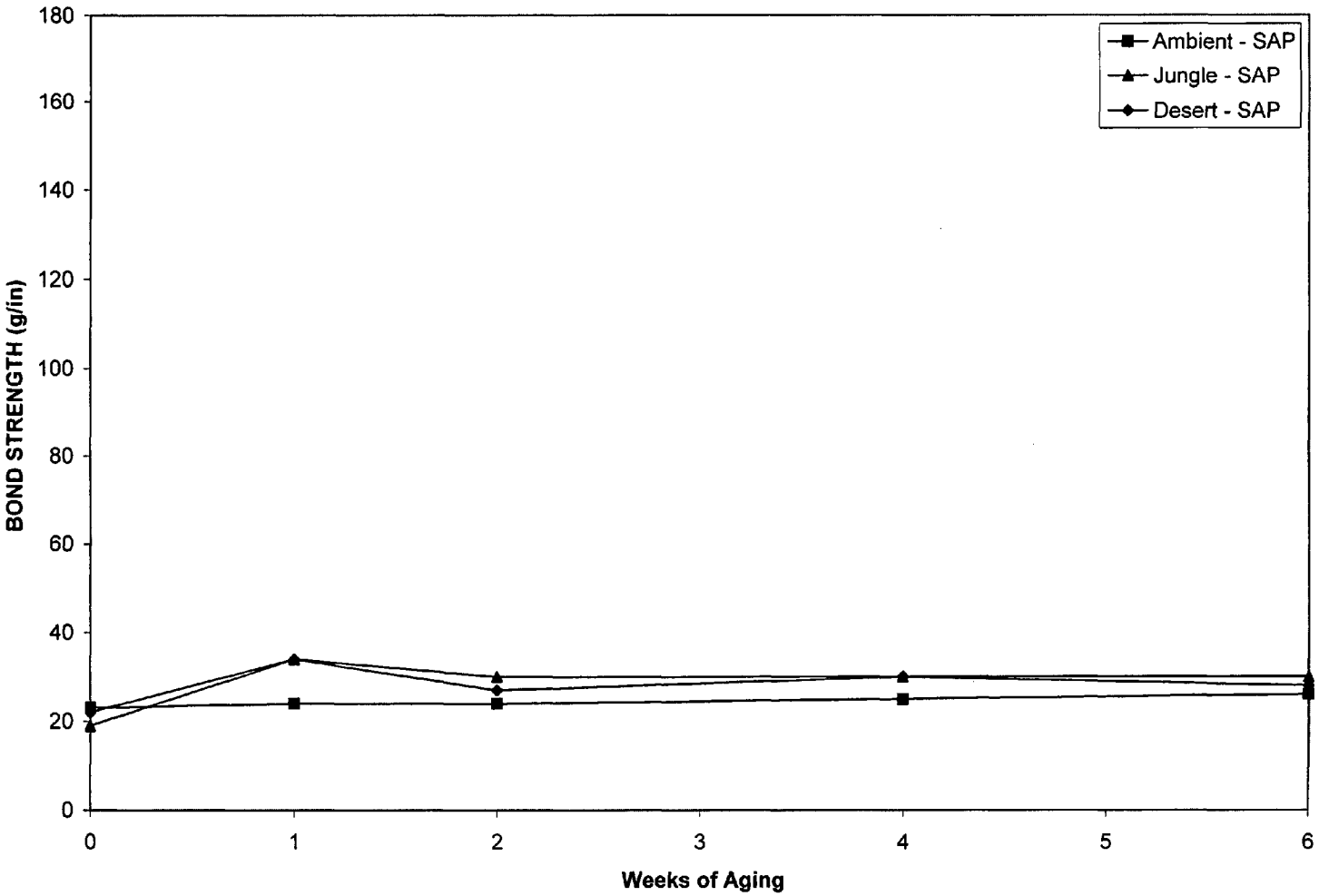
FIG. 12 is a graphical representation of bond strength between cold seal cohesive material and release film over time under ambient, jungle and desert conditions for the embodiment of Example 7.

The flexible liner film of Example 7 comprises a base film comprising LLDPE with Primaseal® 39-01-1 synthetic cold seal cohesive material applied on a surface of the base film. A release film comprising LLDPE is laminated to the base film/cold seal construction such that the LLDPE release film contacts the cold seal cohesive material. FIG. 12 shows the bond strength of the synthetic cold seal cohesive material layer of Example 7 at ambient, jungle and desert conditions over time.

What is claimed is:

1. A packaging system for packaging a product comprising a container having a bottom wall and a plurality of side walls extending from the bottom wall wherein the bottom wall and the plurality of side walls define a product receiving chamber; and a flexible liner film placed in the product receiving chamber wherein the flexible liner film comprises (a) a base film having a first surface and a second surface and at least one side margin, (b) a cold seal cohesive material layer coated on the second surface of the base film, and (c) a release film laminated to the cold seal cohesive material layer;

wherein the cold seal cohesive material layer is coated in a pattern such that at least a portion of at least one side margin of the base film is substantially free of cold seal cohesive material, and wherein the release film overlaps a portion of side margin substantially free of cold seal cohesive material.

2. The packaging system according to claim 1 wherein the flexible liner film is partially attached to the bottom wall of the container in the product receiving chamber.

3. The packaging system according to claim 1 wherein the base film includes an opening feature.

4. The packaging system according to claim 1 wherein the second surface of the base film is treated to promote adhesion with the cold seal cohesive material.

5. The packaging system according to claim 1 wherein the base film includes indicia printed on at least one of the first and second surfaces of the base film.

6. The packaging system according to claim 1 wherein the cold seal cohesive material layer is selected from the group consisting of a natural latex-based cold seal cohesive material and a synthetic cold seal cohesive material.

7. The packaging system according to claim 1 wherein the base film and the release film have substantially equal widths.

8. The packaging system according to claim 1 wherein the base film comprises a polyethylene film.

9. The packaging system according to claim 8 wherein the polyethylene film is linear low density polyethylene film.

10. The packaging system according to claim 1 wherein the release film comprises a polyethylene film.

11. The packaging system according to claim 10 wherein the polyethylene film is linear low density polyethylene film.

12. The packaging system according to claim 10 wherein the polyethylene film has a first surface facing the cold seal cohesive material layer and the first surface includes a lacquer coating.

13. The packaging system according to claim 10 wherein the polyethylene film is laminated to a polypropylene film and the polypropylene film faces the cold seal cohesive material layer.

14. A flexible liner film adaptable for use in a packaging system wherein the flexible liner film comprises (a) a base film having a first surface and a second surface and at least one side margin, (b) a cold seal cohesive material layer coated on the second surface of the base film wherein the cold seal cohesive material is coated in a pattern such that at least a portion of at least one side margin of the base film is substantially free of cold seal cohesive material, and (c) a release film laminated to the cold seal cohesive material layer wherein the release film overlaps a portion of side margin substantially free of cold seal cohesive material.

15. The flexible liner film according to claim 14 wherein the base film is attachable to a container.

16. The flexible liner film according to claim 14 wherein the base film includes an opening feature.

17. The flexible liner film according to claim 14 wherein the base film includes a plurality of opening features.

18. The flexible liner film according to claim 14 wherein the second surface of the base film is treated to promote adhesion with the cold seal cohesive material.

19. The flexible liner film according to claim 14 wherein the base film includes indicia printed on at least one of the first and second surfaces of the base film.

20. The flexible liner film according to claim 14 wherein the cold seal cohesive material layer is selected from the group consisting of a natural latex-based cold seal cohesive material and a synthetic cold seal cohesive material.

21. The flexible liner film according to claim 14 wherein the base film and the release film have substantially equal widths.

22. The flexible liner film according to claim 14 wherein the cold seal cohesive material layer is formed by coating a cold seal cohesive material on the base film in a weight range of from about 1.0 pounds per ream to about 6.0 pounds per ream.

23. The flexible liner film according to claim 14 wherein the base film comprises a polyethylene film.

24. The flexible liner film according to claim 23 wherein the polyethylene film is linear low density polyethylene film.

25. The flexible liner film according to claim 14 wherein the release film comprises a polyethylene film.

26. The flexible liner film according to claim 25 wherein the polyethylene film is linear low density polyethylene film.

27. The flexible liner film according to claim 25 wherein the polyethylene film has a first surface facing the cold seal cohesive material layer and the first surface includes a lacquer coating.

28. The flexible liner film according to claim 25 wherein the polyethylene film is laminated to a polypropylene film and the polypropylene film faces the cold seal cohesive material layer.

29. The flexible liner film according to claim 14 wherein the base film comprises a polyethylene film, the cold seal cohesive material comprises a synthetic cold seal cohesive material and the release film comprises a polyethylene film.

30. The flexible liner film according to claim 29 wherein the polyethylene film has a first surface facing the cold seal cohesive material layer and the first surface includes a lacquer coating.

31. The flexible liner film according to claim 29 wherein the polyethylene film is laminated to a polypropylene film and the polypropylene film faces the cold seal cohesive material layer.

32. A flexible liner film for a container wherein the flexible liner film comprises (a) a base film attachable to a container wherein the base film has a first surface and a second surface and at least one side margin, (b) a cold seal cohesive material layer coated on the second surface of the base film wherein the cold seal cohesive material is coated in a pattern such that at least a portion of at least one side margin of the base film is substantially free of cold seal cohesive material, and wherein the cold seal cohesive material layer is selected from the group consisting of a natural latex-based cold seal cohesive material and a synthetic cold seal cohesive material, and (c) a release film laminated to the cold seal cohesive material layer wherein the release film overlaps a portion of side margin substantially free of cold seal cohesive material, and wherein the release film comprises a polypropylene film, a polyethylene film or a lacquer-coated polyethylene film.

33. The flexible liner film according to claim 32 wherein the base film includes an opening feature.

34. The flexible liner film according to claim 32 wherein the base film includes a plurality of opening features.

35. The flexible liner film according to claim 32 wherein the second surface of the base film is treated to promote adhesion with the cold seal cohesive material.

36. The flexible liner film according to claim 32 wherein the base film includes indicia printed on at least one of the first and second surfaces of the base film.

37. The flexible liner film according to claim 32 wherein the base film and the release film have substantially equal widths.

38. The flexible liner film according to claim 32 wherein the base film has a thickness of from about 0.5 mil to about 10.0 mil, the cold seal cohesive material layer is coated on the base film in a weight range of from about 1.0 pounds per ream to about 6.0 pounds per ream, and the release film has a thickness of from about 0.3 mil to about 10.0 mil.

39. The flexible liner film according to claim 32 wherein the base film has a thickness of from about 1.5 mil to about 7.5 mil, the cold seal cohesive material layer is coated on the base film in a weight range of from about 2.0 pounds per ream to about 4.0 pounds per ream, and the release film has a thickness of from about 1.0 mil to about 5.0 mil.

40. The flexible liner film according to claim 32 wherein the base film comprises a polyethylene film.

41. The flexible liner film according to claim 40 wherein the polyethylene film is linear low density polyethylene film.

* * * * *